US006616494B1

(12) United States Patent
Nagata et al.

(10) Patent No.: US 6,616,494 B1
(45) Date of Patent: Sep. 9, 2003

(54) METHOD AND APPARATUS FOR SUPPLYING PELLETS TO ARC TUBE FOR DISCHARGE LAMP

(75) Inventors: Akihiro Nagata, Shizuoka (JP); Kunio Fukai, Shizuoka (JP); Masakazu Nagasawa, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/599,502

(22) Filed: Jun. 23, 2000

(30) Foreign Application Priority Data

Jun. 25, 1999 (JP) ..... 11-179957

(51) Int. Cl.[7] ..... H01J 9/395
(52) U.S. Cl. ..... 445/9; 445/70
(58) Field of Search ..... 445/9, 26, 70

(56) References Cited

U.S. PATENT DOCUMENTS 5,259,533 A * 11/1993 Kornfein et al. ..... 222/170
5,286,227 A 2/1994 Numajiri et al. ..... 445/26
5,505,648 A 4/1996 Nagasawa et al. ..... 445/26
5,601,465 A 2/1997 Fukuyo et al. ..... 445/6
5,936,349 A * 8/1999 Fukai et al. ..... 313/623
5,996,768 A * 12/1999 Boyce et al. ..... 198/397.01

FOREIGN PATENT DOCUMENTS

| | | |
|---|---|---|
| GB | 1 254 189 | 11/1971 |
| GB | 2 159 504 | 12/1985 |
| JP | 62-118340 | 7/1987 |

* cited by examiner

*Primary Examiner*—Kenneth J. Ramsey
(74) *Attorney, Agent, or Firm*—Sughrue Mion, PLLC

(57) ABSTRACT

Supplying pellets without the risk of enlarging the apparatus size or moisture absorption of the pellets by disposing a rotation drum provided with a pellet storage room in a sealed case with an inert gas supply.

The apparatus according to the present invention has a main body case with a rotation drum storage part formed therein, a lid mounted on the front surface opening part of the main body case, a rotation drum disposed rotatably in the rotation drum storage part, and a pellet supply nozzle elongating from the main body. Through holes having a size capable of inserting a pellet are provided on the circumferential wall of the rotation drum with an equal interval in the circumferential direction as well as the side wall of the main body case to be contacted slidably with the circumferential wall of the rotation drum. A gas supply hole for supplying an inert gas into the pellet storage room via the through holes, and a pellet discharging hole for discharging the pellets in the through holes at the time it coincides with the pellet storing through holes according to rotation of the rotation drum.

15 Claims, 8 Drawing Sheets

METHOD AND APPARATUS FOR SUPPLYING PELLETS TO ARC TUBE FOR DISCHARGE LAMP

BACKGROUND OF THE INVENTION

1. Field of the Invention

The present invention relates to a method and apparatus for supplying a predetermined amount of a pelletized metal halide (hereinafter referred to as a "pellet") to a chamber part of an arc tube when producing an arc tube for a discharge lamp having a sealed chamber part with electrodes, a light emitting substance such as mercury, and a metal halide sealed therein.

2. Description of the Related Art

As shown in FIG. 12, according to a conventional apparatus such as disclosed in JP-A-62-118340U, a rotor 1 having recess parts 2 for holding pellets P on its outer periphery and a hopper 3 for storing the pellets P therein such that the outer circumferential surface of the rotor 1 faces the inside of the hopper 3, with a suction space part 5 and an exhaust space part 6 provided in the rotor 1. A hole 7, provided in the recess part 2 of the rotor 1, communicates with the suction space part 5 or the exhaust space part 6 for providing a suction or exhaust path so that the pellets P in the hopper 3 enter into the recess parts 2 so as to be held by adsorption. The pellets P are discharged by the exhaust through hole 7 when the recess parts 2 storing the pellets P reach the scheduled discharging position according to the rotation of the rotor 1.

However, according to the conventional technique, since the hopper 3 is provided outside the rotor 1, the apparatus is bulky. In addition, since the pellets (metal halide) P are highly hygroscopic, they deliquesce when they are exposed to the atmosphere. When this occurs, it is difficult to supply the pellets one at a time to the chamber of the arc tube. In addition, metal halide pellets, such as those used here, that absorb moisture drastically, deteriorate the lamp characteristics.

SUMMARY OF THE INVENTION

In view of the problems of the conventional technique, an object of the present invention is to provide an apparatus and method for supplying pellets without the risk of enlarging the apparatus size while preventing moisture absorption of the pellets by disposing a rotation drum provided with a pellet storage room in a sealed case with an inert gas supply.

In order to achieve these objectives, one embodiment of the present invention is an apparatus and method for supplying pellets to an arc tube for a discharge lamp by picking up one pellet from a group of pellets, made from a metal halide. These pellets are stored in a pellet storage room comprising a main body case with a rotation drum storage part opened in the front surface side, a lid to be mounted on the front surface opening part of the apparatus main body case for sealing the rotation drum storage part, a rotation drum disposed rotatably in the rotation drum storage part with the pellet storage room having a rotating member shape formed on the front surface side facing to the lid, and a pellet supply nozzle elongating from the apparatus main body, wherein through holes having a size capable of inserting a pellet are provided on the circumferential wall of the rotation drum with an equal interval in the circumferential direction. In addition, the part of the apparatus main body case facing the circumferential wall of the rotation drum is provided with an arc-like slidably contacting surface to be contacted with the circumferential wall of the rotation drum slidably for holding the pellets stored in the through holes in the through holes, a gas supply hole for supplying an inert gas into the pellet storage room via the through holes, and a pellet discharging hole communicating with the pellet supply nozzle, for discharging the pellets in the through holes at the time it coincides with the pellet storing through holes according to rotation of the rotation drum.

According to rotation of the rotation drum, a pellet enters into the through hole at the substantially lowermost position by its self weight. Since the slidably contacting surface elongates in the circumferential direction below the through holes, even in the case the rotation drum rotates, the pellet in the through hole is supported by the slidably contacting surface from below so as to be held in the through hole. According to rotation of the rotation drum, the through hole with the pellet stored (hereinafter referred to as the "pellet storing through hole") moves upward so as to be separated form the pellet group in the pellet storage room. When the pellet storing through hole reaches the position corresponding to the pellet discharging hole, the pellet is discharged into the pellet discharging hole according to the pellet's own weight and according to the inert gas flow from the inside of the pellet storage room to the pellet discharging hole via the pellet storing through hole. The pellet discharged into the pellet discharging hole is supplied to the chamber part of the arc tube by the pellet supply nozzle. According to further rotation of the rotation drum so that the next pellet storing through hole reaches the position corresponding to the pellet discharging hole, similarly, the pellet is discharged into the pellet discharging hole so as to be supplied to the chamber part of the arc tube by the pellet supply nozzle. Accordingly, the pellets are supplied successively, one at a time.

Since the pellet storage room is provided in the rotation drum disposed in the apparatus main body case (rotation drum storage room) and a large number of pellets can be stored in the pellet storage room, unlike the conventional apparatus, the hopper needs not be provided outside the rotation drum (rotor). Since the inert gas is introduced from the gas supply hole provided in the apparatus main body case and the through holes provided on the circumferential wall of the rotation drum into the pellet storage room so that the inside of the pellet storage room can be maintained in the inert gas atmosphere, the problems of the deliquescence of the pellet in the pellet storage room by the contact with the atmosphere or excessive moisture in the pellets can be prevented.

Another aspect of the present invention is the method and apparatus for supplying pellets to an arc tube for a discharge lamp wherein the rotation drum storage part has an inner circumferential surface formed in a cylindrical shape to be contacted slidably with the circumferential walls entire circumference of the rotation drum as well as the gas supply hole, and is provided with a manifold elongating in the circumferential direction for ensuring communication with at least one of the through holes. Wherever the rotation drum is disposed with respect to the circumferential direction, communication between the gas supply hole and the through holes can be ensured via the manifold so that the inert gas is always introduced into the pellet storage room.

In particular, the inert gas introduced into the pellet storage room via the gas supply hole, the manifold, and the through holes form an inert gas flow from the through hole at a position close to the pellet discharging hole, passing through the gap (slidably contacting surface) between the rotation drum and the rotation drum storage part so as to flow into the pellet discharging hole. The inert gas flow from the inside of the through hole (inside of the pellet storage room) toward the outside (outside of the pellet storage room) promotes storage of the pellet into the through hole by dropping at the scheduled storing position and forces the pellet in the through hole until the pellet storing through hole reaches a position that corresponds to the pellet discharging hole according to rotation of the rotation drum. Since the inert gas in the pellet storage room can easily flow into the pellet discharging hole from the pellet storing through hole when the pellet storing through hole reaches the position corresponding to the pellet discharging hole, the inert gas flow facilitates the discharge of the pellet in the through hole into the pellet discharging hole. Furthermore, in the case the pressure in the pellet storage room is larger than the atmospheric pressure, when the pellet storing through hole reaches the position corresponding to the pellet discharging hole, the pressure in the pellet storage room is released via the pellet discharging hole and the inert gas flows out by the speed according to the pressure and the pellet is discharged at the same time.

Another embodiment of the present apparatus and method for supplying pellets to an arc tube for a discharge lamp has an arc-like slidably contacting surface provided facing the area of the substantially lower half of the circumferential wall of the rotation drum. Wherever the rotation drum is disposed with respect to the circumferential direction, communication between the through holes at a position not facing the arc-like slidably contacting surface and the gas supply hole can be ensured via the gap between the upper half of the circumferential wall and the inner circumferential surface of the rotation drum storage part so that the inert gas is always introduced into the pellet storage room.

Another embodiment of the present apparatus and method for supplying pellets to an arc tube for a discharge lamp according to any of the before mentioned embodiments has a gas pressure in the pellet storage room of the apparatus being maintained in the range from 0.02 to 0.1 $kg/cm^2$ by adjusting the pressure of the inert gas to be supplied to the gas supply hole. It is preferable that the gas pressure in the pellet storage room is higher than the pressure outside the pellet storage room so that the discharge of the pellets, stored in the through holes, is facilitated. However, if the gas pressure in the pellet storage room is too high, there is a risk of storing a plurality of pellets in a through hole at the same time which may cause choking or cracking of the pellets. Therefore, in order to discharge the pellets from the discharging hole smoothly, without choking the through holes or cracking the pellets, it is preferable to set the gas pressure in the pellet storage room at a predetermined value in the range from 0.02 to 0.1 $kg/cm^2$.

Another embodiment of the present apparatus and method for supplying pellets to an arc tube for a discharge lamp according to any of the previous embodiments is an apparatus having a lid, provided so as to be opened or closed by swaying around the part supported by the apparatus main body case. The pellet storage room can be opened by swaying the lid for refilling a new pellet group in to the pellet storage room.

Another embodiment of the present apparatus and method for supplying pellets to an arc tube for a discharge lamp according to any of the previous embodiments is a V-shaped groove provided on the inner circumferential wall of the rotation drum comprising the pellet storage room as well as the through holes provided on the bottom part of the V-shaped groove. Since the pellet group in the pellet storage room gather at the bottom part of the V-shaped groove according to its self weight, even in the case the amount of the pellet group remaining in the pellet storage room is small, the pellets can be introduced into the through holes.

Another embodiment of the present apparatus and method for supplying pellets to an arc tube for a discharge lamp according to any of the previous embodiments is a through hole with a depth H, formed in the range from $D/2<H\leqq D$ with the proviso that the inner diameter of the through holes is D. In the case the depth H of the through holes is larger than the hole diameter D, entrance of two or more pellets into the discharge holes can be allowed. This may cause choking or supply of two or more pellets to the chamber of the arc tube at the same time. Moreover, in the case the depth H of the through holes is smaller than ½ of the hole diameter D, there is a risk of discharge of the pellet from the through hole before the pellet storing through hole reaches a position corresponding to the pellet discharging hole so as to return the pellet to the group of pellets before delivering it to the chamber of the arc tube. Accordingly, the depth H of the through holes is set in the range from $D/2<H\leqq D$. D being the inner diameter of the through holes.

DETAILED DESCRIPTION OF THE PREFERRED EMBODIMENTS

Figure 1:
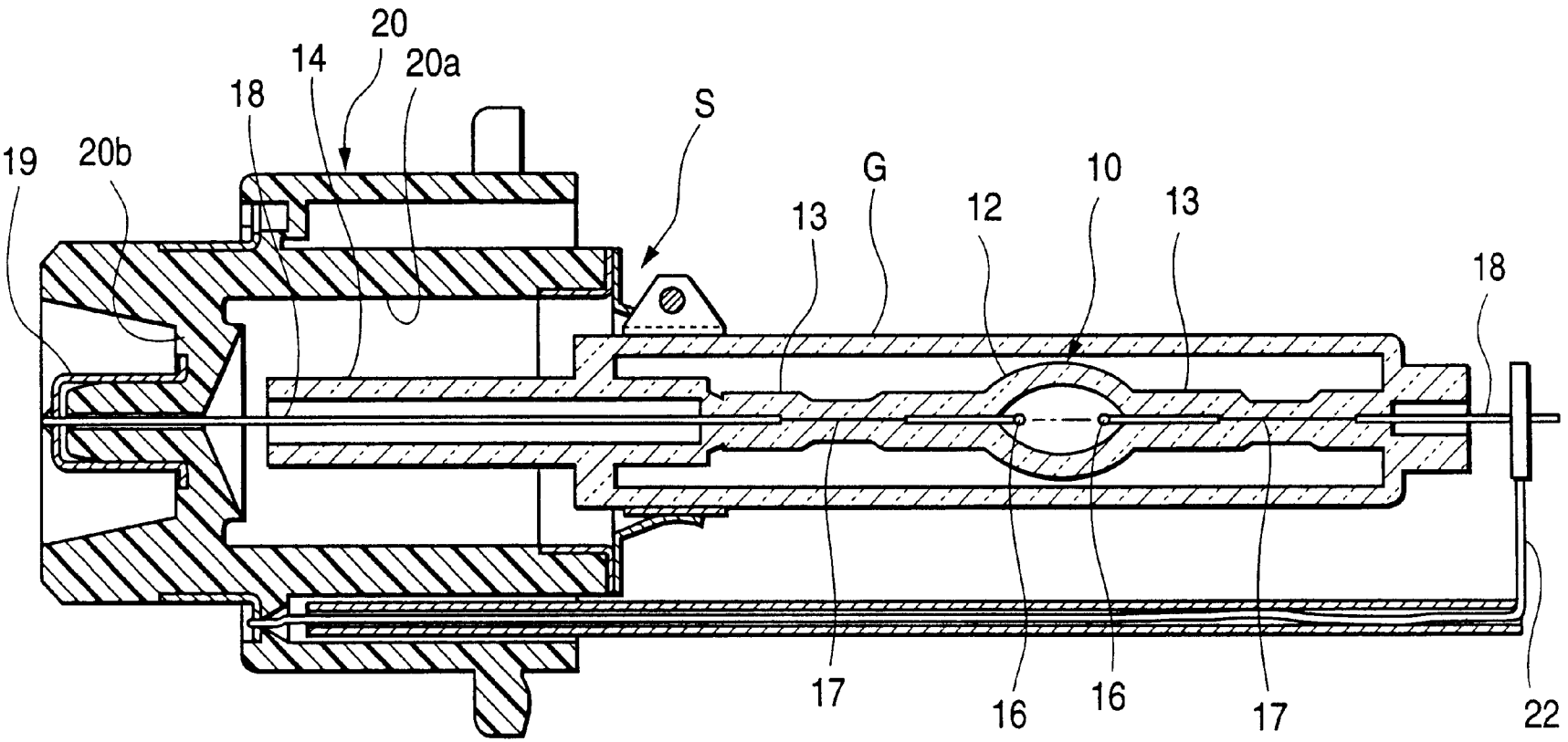
FIG. 1 is a vertical cross-sectional view of a discharge valve of a head lamp for an automobile comprising an arc tube produced by an apparatus for supplying pellets according to one embodiment of the present invention.

The invention will now be explained with reference to the drawings. FIG. 1 shows a discharge valve for a head lamp, with the arc tube 10 mounted on an insulating base 20, wherein the front end part of the arc tube 10 is supported by a lead support 22 projecting forward with respect to the insulating base 20, the rear end part of the arc tube 10 is supported by a recess part 20*a* of the base 20, and further, a portion close to the rear end part of the arc tube 10 is gripped by a metal supporting member S fixed to the front surface of the insulating base.

The front end side lead line 18 elongating from the arc tube 10 is fixed to the lead support 22 by welding. In contrast, the rear end side lead line 18 is inserted through a bottom wall 20*b* for forming the recess part 20*a* of the base 20 so as to be fixed to a terminal 19 provided on the bottom wall 20*b* by welding. The mark G denotes a cylindrical globe for blocking the ultraviolet rays that are emitted from the arc tube 1 that can be hazardous to the human body, the cylindrical globe being integrally welded to the arc tube 10.

An arc tube 10 comprises a round pipe-like quartz glass tube W with a linear elongating part $w_1$ having a spherical bulging part $w_2$ formed halfway in the longitudinal direction, pinch-sealed at a position close to the spherical bulging part $w_2$ so as to form an elliptic tipless sealed chamber part 12 to serve as a discharging space, with pinch seal parts 13, 13 having a rectangular lateral cross-section formed at both end parts thereof. A starting rare gas, mercury and a light emitting substance such as a metal halide are sealed in the sealed chamber part 12. Moreover, tungsten electrode bars 16, 16 comprising discharge electrodes are formed facing each other in the sealed chamber part 12. The electrode bars 16, 16 are connected with molybdenum foils 17, 17 sealed in the pinch seal parts 13, 13. Molybdenum lead lines 18, 18 connected with the molybdenum foils 17, 17 are introduced from the end parts of the pinch seal parts 13, 13 outward, with the rear end side lead line 18 inserted through a round pipe shape part 14 as a pinch sealed part, elongating to the outside.

Figure 2A:
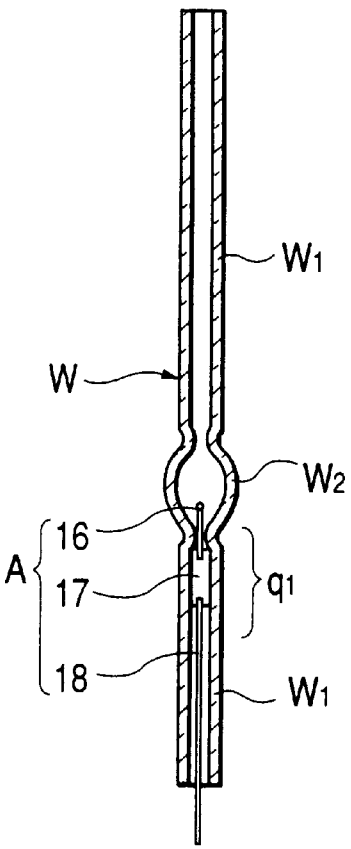
FIG. 2A is an explanatory diagram for a primary pinch seal step.

For the production of the arc tube 10, as shown in FIG. 2A, with an electrode assembly A comprising the electrode bar 16, the molybdenum foil 17 and the lead line 18 connected integrally, inserted into one opening end side of the cylindrical glass tube W having the spherical bulging part $w_2$ formed halfway in the linear elongating part $w_1$, a position $q_1$ in the vicinity of the spherical bulging part $w_2$ is primary pinch-sealed.

Figure 2B:
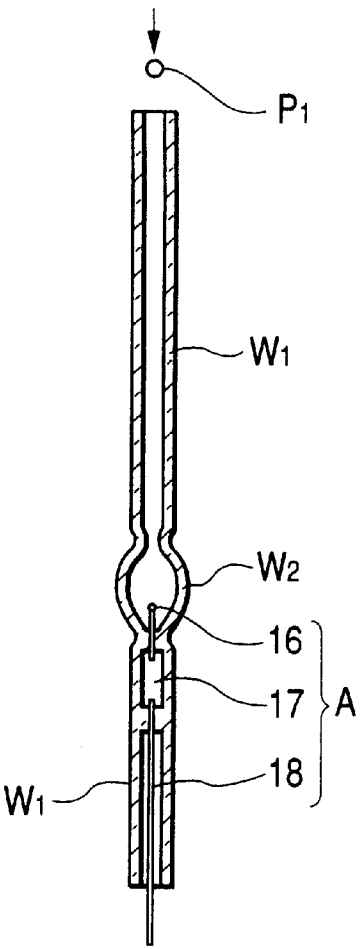
FIG. 2B is an explanatory diagram for a mercury supplying step.
Figure 2C:
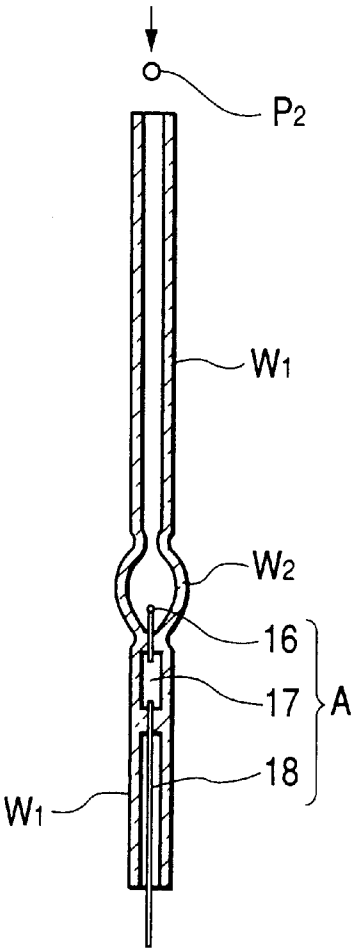
FIG. 2C is an explanatory diagram for a metal halide supplying step.
Figure 2D:
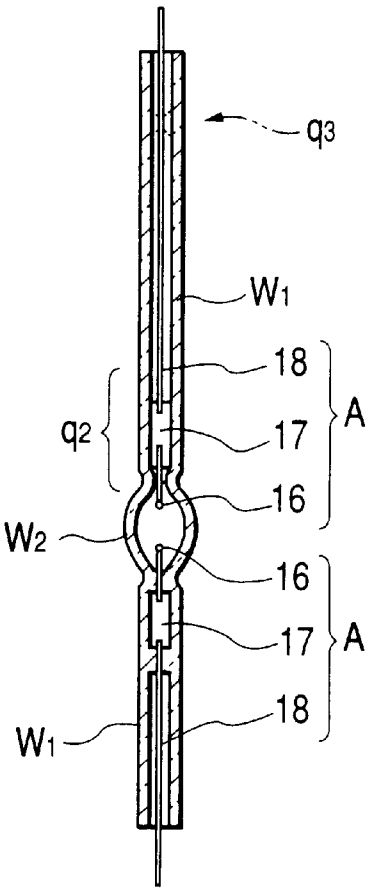
FIG. 2D is an explanatory diagram for a secondary pinch seal step.
Figure 3:
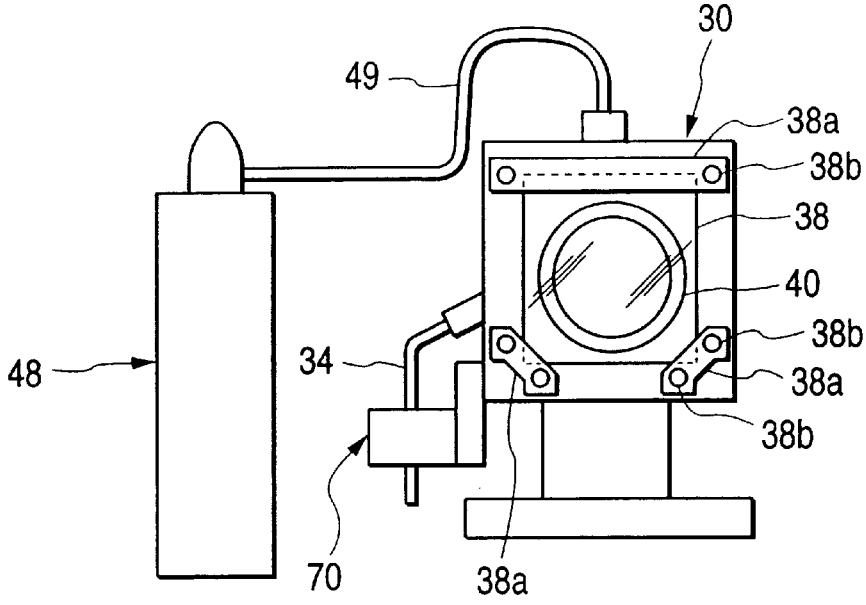
FIG. 3 is a plan view of one embodiment of a pellet supplying apparatus according to another embodiment of the present invention.
Figure 4:
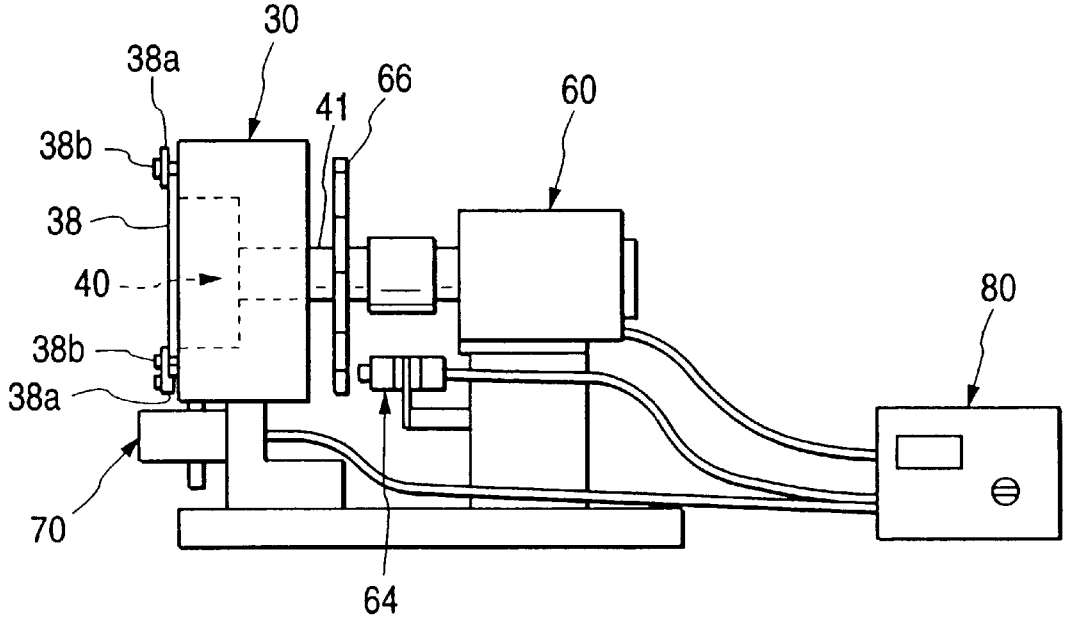
FIG. 4 is a side view of the apparatus according to one embodiment of the present invention.

Then, as shown in FIGS. 2B and 2C, mercury $P_1$, and a light emitting substance such as a metal halide pellet $P_2$ are introduced into the spherical bulging part $w_2$ (chamber part 12) from the other opening end side opened upward. As shown in FIG. 2D, after inserting another electrode assembly A comprising the electrode bar 16, the molybdenum foil 17 and the lead line 18 connected integrally into the opening end side, a position $q_2$ in the vicinity of the spherical bulging part $w_2$ is secondary pinch-sealed while heating so as to seal the spherical bulging part $w_2$ for completing the arc tube 10 having the tipless sealed chamber part 12.

In the primary pinch seal step shown in FIG. 2A, the pinch seal is executed while introducing an inert gas (in general, an inexpensive argon gas) into the glass tube W as the foaming gas so as not to oxidize the electrode assembly A. Furthermore, in the secondary pinch seal step shown in FIG. 2D, the pinch seal is executed with the opening end of the linear elongating part $w_1$ closed by pinch seal as shown by the mark $q^3$ in FIG. 2D after supplying an Xe gas into the glass tube W so as not to vaporize the light emitting substance as well as with the spherical bulging part $w_2$ cooled with a liquid nitrogen so that the inside of the glass tube W can be in a state close to the vacuum.

As shown in FIGS. 3 to 6, the pellet supplying apparatus for supplying pellets made from a metal halide to the chamber part 12 of an arc tube 10 according to a method and apparatus of the present invention comprises an apparatus main body case 30 with a rotation drum 40, an Ar gas bomb 48 connected with a gas supply hole 32 provided in the apparatus main body case 30, a driving motor 60 for rotating the rotation drum 40 with respect to the apparatus main body case 30, a position detector 64 for detecting the position of the rotation drum 40 in the circumferential direction by detecting the calibrations of a disc 66 provided on the rotation driving axis on the rotation drum 40 side, a pellet supply nozzle 34 elongating from a pellet discharging hole 33 of the apparatus main body case 30, a pellet detecting sensor 70 supported by the apparatus main body case 30 for detecting the number of pellets passing through the pellet supply nozzle 34, and a control device 80 for controlling the drive of the driving motor 60 (rotation of the rotation drum 40) based on the detection information from the pellet detecting sensor 70 and the position detector 64.

Figure 5:
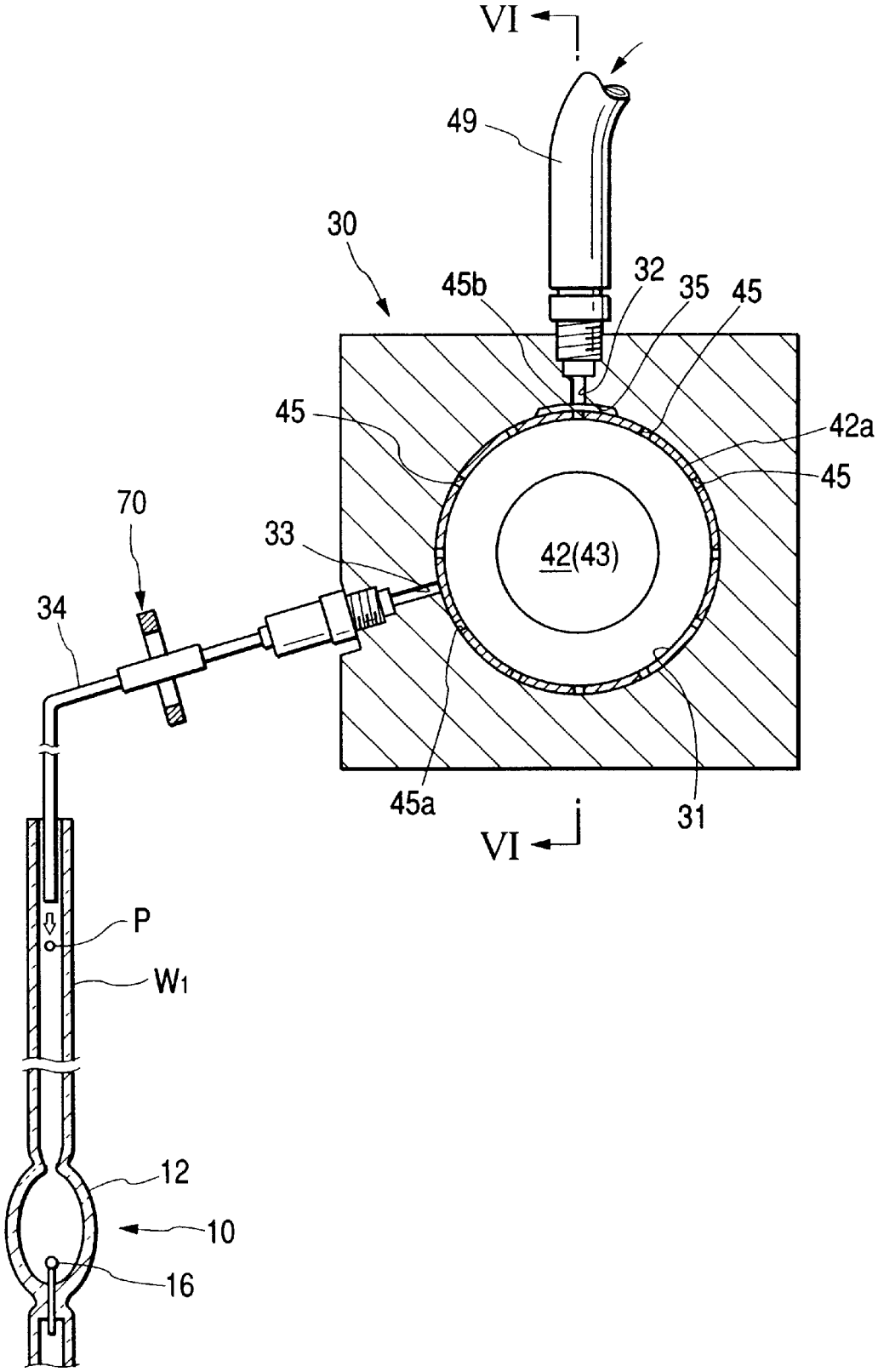
FIG. 5 is a principal part enlarged plan view showing a part of the apparatus in the cross-section.
Figure 6:
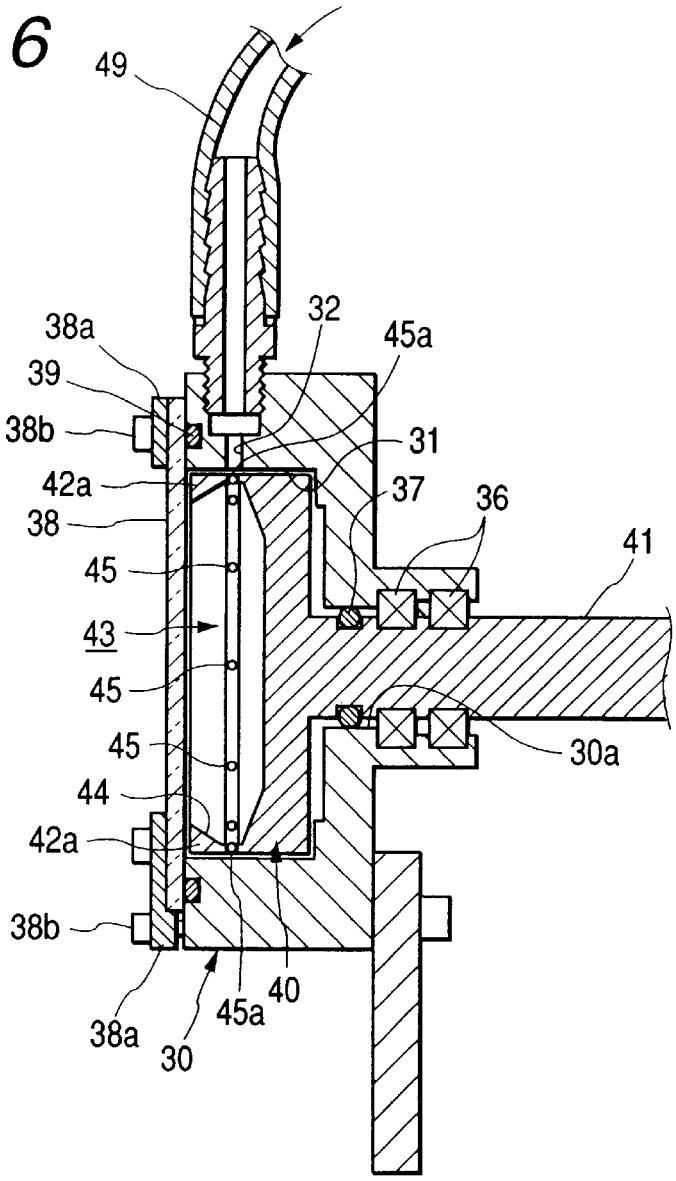
FIG. 6 shows an enlarged cross-section view of the apparatus taken along line VI—VI in FIG. 5.

The internal structure of the apparatus main body case 30 is shown in FIGS. 5 and 6. An opening part 31 with a rotating member shape is provided on the front surface side of the apparatus main body case 30 with a rectangular shape as the rotation drum storage part. A lid 38 is fixed on the front surface of the apparatus main body case 30 by screwing so as to seal the inside of the apparatus main body case 30 (rotation drum storage part 31). The rotation drum 40 provided with a pellet storage room 42 rotates in the sealed rotation drum storage part 31.

Since the lid 38 is made from a transparent glass, the amount of pellets remaining in the pellet storage room 42 can be confirmed without opening the lid 38. The main body also has a bracket 38*a* and a fastening screw 38*b* for fixing the lid 38, an O ring 39 disposed between the front surface of the apparatus main body case 30 and the lid 38 for sealing, an O ring 37 for sealing disposed between the rotation driving axis 41 on the rotation drum 40 side and a rotation driving axis through hole 30*a* and a ball bearing 36, disposed between the apparatus main body case 30 and the rotation driving axis 41 of the rotation drum 40.

A recessed space 43 with a rotating member shape having a V-shaped groove 44 formed inside the circumferential wall 42*a* thereof is provided on the front surface side of the rotation drum 40. Furthermore, the rotation drum 40, disposed in the rotation drum storage part 31, is held with the front surface side thereof adjacent to the lid 38 so that the pellet storage room 42 is formed by the recessed space 43 and the lid 38. A large number of pellets P with the substantially same size are stored in the pellet storage room 42.

Through holes 45 having a size capable of inserting a pellet are provided on the bottom part of the V-shaped groove 44 of the circumferential wall 42*a* of the rotation drum 40 in the circumferential direction at positions divided in twelve equal parts. That is, the through holes 45 are provided with a 30 degree pitch from the rotation center of the rotation drum 40. Since inclined surfaces 44*a*, 44*b* comprising the V-shaped groove 44 elongate to the through holes 45, the pellets stored in the pellet storage room 42 roll toward the through holes 45 spontaneously, and thus the pellet P can easily be inserted into the through holes 45.

Figure 7:
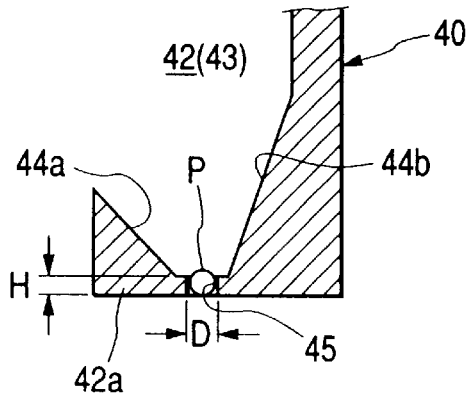
FIG. 7 is an enlarged cross-sectional view showing the shape of the vicinity of a through hole.

Moreover, since the hole diameter of the through holes 45 is set to be about 1.2 times as much as the average particle size d of the pellets P (d=0.40 mm), one pellet can smoothly enter into each of the through holes 45. In addition, because of the size of the through holes, no more than one pellet at a time can enter into each of the through holes 45. Further, as shown in FIG. 7, the depth H of the through holes 45 is set to be H=0.8D, D being the inner diameter of the through holes, so that the top part of the pellet P stored in a through hole 45 projects into the pellet storage room 42 which helps prevent the entrance of another pellet P into the through hole 45.

The circumferential wall 42*a* of the rotation drum 40 is provided so as to be rotatable with respect to the inner circumferential surface of the rotation drum storage part 31. The pellets P stored in the through holes 45 rotate integrally with the rotation drum 40 in the state stored in the through holes 45 according to the rotation of the rotation drum 40.

Moreover, the gas supply hole 32 opened in the apparatus main body case 30 (rotation drum storage part 31) is provided on the upper side wall of the apparatus main body case 30 (rotation drum storage part 31) and is connected with a pipe 49 elongating from the Ar gas bomb 48. In contrast, a pellet discharging hole 33 is provided in the substantially center part in the vertical direction of the left side wall of the apparatus main body case 30 (side wall on the left side with the apparatus main body case 30 viewed from the front side), opened from the rotation drum storage part 31 side to the outside, pointing obliquely downward at an angle of 15 degrees. The pellet discharging hole 33 is connected with a pellet supply nozzle 34 (see FIG. 5) with the tip part thereof elongating into the linear elongating part (glass tube) $w_2$ of the arc tube 10. Moreover, the aperture of the pellet discharging hole 33 is formed slightly larger than the aperture of the through holes 45 so as to facilitate discharge of the pellets P in the through holes 45.

A groove 35, elongating in the circumferential direction, is formed at the opening part of the gas supply hole 32 on the rotation drum storage part 31 side such that the inside of the pellet storage room 42 of the rotation drum 40 can always communicate with the gas supply hole 32 via the through holes 45. That is, the groove 35 serves as a manifold for always ensuring communication between the through holes 45 and the gas supply hole 32 regardless of the position of the rotation drum 40 in the circumferential direction. The Ar gas supplied from the gas supply hole 32 is set at a 0.05 kg/cm$^2$ pressure so that the inside of the pellet storage room 42 is maintained in a 0.05 kg/cm$^2$ Ar gas atmosphere.

The operation of the pellet supplying apparatus and method according to the above embodiment of the present invention will be explained with reference to FIGS. 5 and 8A to 8D.

Figure 8A:
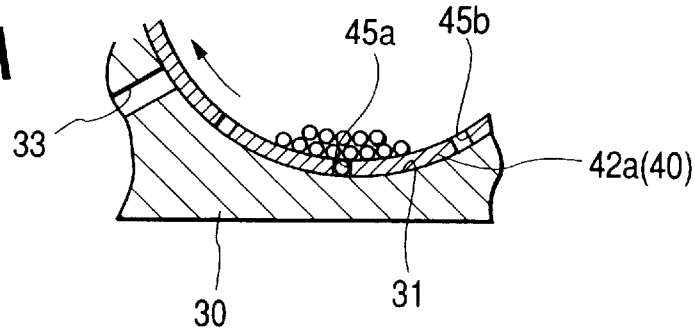
FIG. 8A is a diagram showing the state with a pellet entered in a through hole.
Figure 8B:
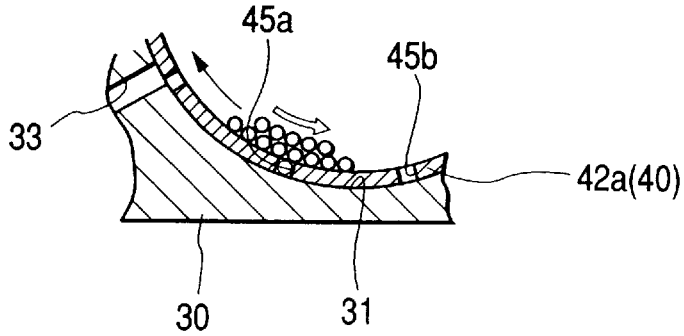
FIG. 8B is a diagram showing the state of the pellet in the through hole moving along the rotation drum.

As shown in FIG. 5, in the case the rotation drum 40 is rotated with the tip end part of the pellet supply nozzle 34 inserted through the linear elongating part $w_1$ of the arc tube 10, a pellet P is stored in a through hole 45 at the bottom part position in the pellet storage room 42 as shown in FIG. 8A. As the rotation of the rotation drum 40 proceeds, as shown in FIGS. 8B and 8C, the pellet P stored in the through hole 45 is separated form the pellet group in the pellet storage room 42.

Figure 8C:
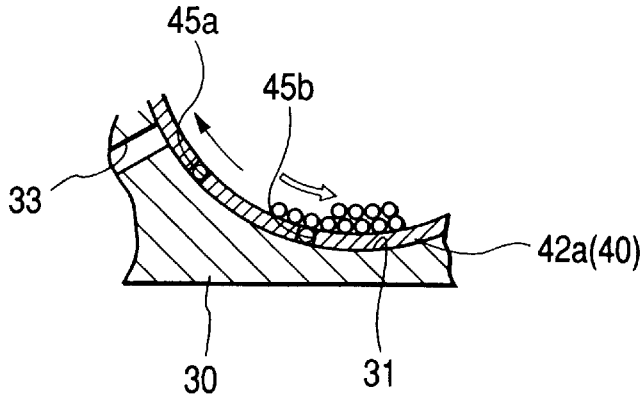
FIG. 8C is a diagram showing the state of the pellet in the through hole separated from the pellet group according to rotation of the rotation drum.
Figure 8D:
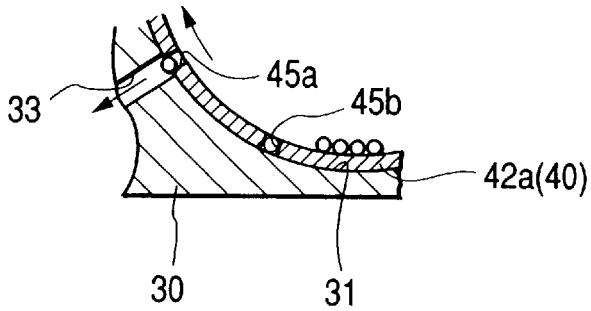
FIG. 8D is a diagram showing the state of the pellet being discharged when the pellet storing through hole reaches the position corresponding to the discharging hole.

As the rotation of the rotation drum 40 proceeds further, as shown in FIG. 8D, the pellet storing through hole 45*a* reaches the position corresponding to the pellet discharging hole 33. Since the pellet storage room 42 always communicates with the gas supply hole 32 via the other through holes 45 and the manifold 35 so that the pressure in the pellet storage room 42 is maintained at 0.05 kg/cm$^2$, the pressure in the pellet storage room 42 is released via the pellet storing through hole 45*a* and the pellet discharging hole 33 so that the Ar gas in the pellet storage room 42 is discharged vigorously from the pellet storing through hole 45*a* to the pellet discharging hole 33. At that time, the pellet P in the pellet storing through hole 45*a* is discharged to the pellet discharging hole 33 together with the Ar gas. The pellet P discharged in the pellet discharging hole 33 is supplied from the linearly elongating part $w_1$ of the arc tube 10 into the chamber part 12 via the pellet supply nozzle 34.

In the meantime, as shown in FIGS. 8C and 8D, another pellet P is stored in the adjacent successive through hole 45*b*. When the pellet storing through hole 45*b* reaches a position corresponding to the pellet discharging hole 33, the pellet P in the through hole 45*b* is discharged into the pellet discharging hole 33 by the Ar gas in the pellet storage room 42 again. The pellet P discharged in the pellet discharging hole 33 is supplied from the linearly elongating part $w_1$ of the arc tube 10 into the spherical bulging part $w_2$ (chamber part 12) via the pellet supply nozzle 34. Accordingly, the pellets P can be supplied one by one from the pellet supply nozzle 34 continuously according to the rotation of the rotation drum 40.

Generally, the number of pellets P to be supplied to an arc tube is two. The number of the pellets P passing through the pellet supply nozzle 34 is detected by the pellet detecting sensor 70 which is outputted to the control device 80. In the case supply of two pellets P into the arc tube 10 in a predetermined time is confirmed by a signal from the pellet detecting sensor 70, a CPU (not illustrated) in the control device 80 controls the drive of the motor 60 so as to stop the rotation of the rotation drum 40. In addition, the arc tube gripping member (not illustrated) replaces the arc tube as the subject of supplying pellets by the pellet supply nozzle 34 by a new arc tube. Moreover, the position of the rotation drum 40 is always detected by the position detector 64 so that the rotation drum 40 is stopped according to a signal from the position detector 64 such that the pellet discharging hole 33 can be disposed between the adjacent through holes 45, 45.

When a new arc tube is set to the pellet supply nozzle 34 by the arc tube gripping member, the completion of the setting of the arc tube is outputted to the CPU in the control device 80 so that the CPU controls the drive of the motor 60 so as to resume the rotation of the rotation drum 40.

By maintaining the pressure in the pellet storage room 42 higher than the atmospheric pressure, in addition to the vigorous discharge of the pellets P, the following advantages can be achieved.

Since a slight gap is formed between the circumferential wall 42*a* of the rotation drum 40 and the inner circumferential wall (slidably contacting part) of the rotation drum storage part 31, the inert gas in the pellet storage room 42 with a high pressure forms a flow from the through hole 45 disposed close to the pellet discharging hole 33, into the pellet discharging hole 33 passing through the gap. The inert gas flow from the inside of the through hole 45 (inside of the pellet storage room 42) toward the outside (outside of the pellet storage room 42) promotes storage of the pellet P in the through hole 45 by dropping at the scheduled storing position as well as forces the pellet P in the through hole 45*a* after the storage of the pellet P in the through hole 45 until the pellet storing through hole 45*a* reaches the position corresponding to the pellet discharging hole 33 according to rotation of the rotation drum 40.

Figure 9:
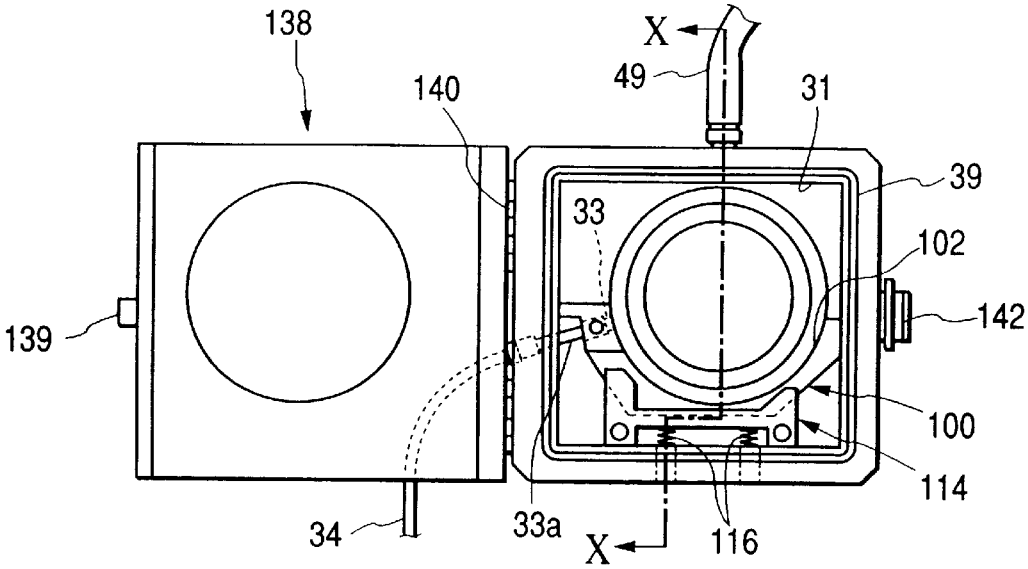
FIG. 9 is a plan view of another embodiment of a pellet supplying apparatus according to the present invention with the lid of the apparatus main body case as the principal part opened.
Figure 10:
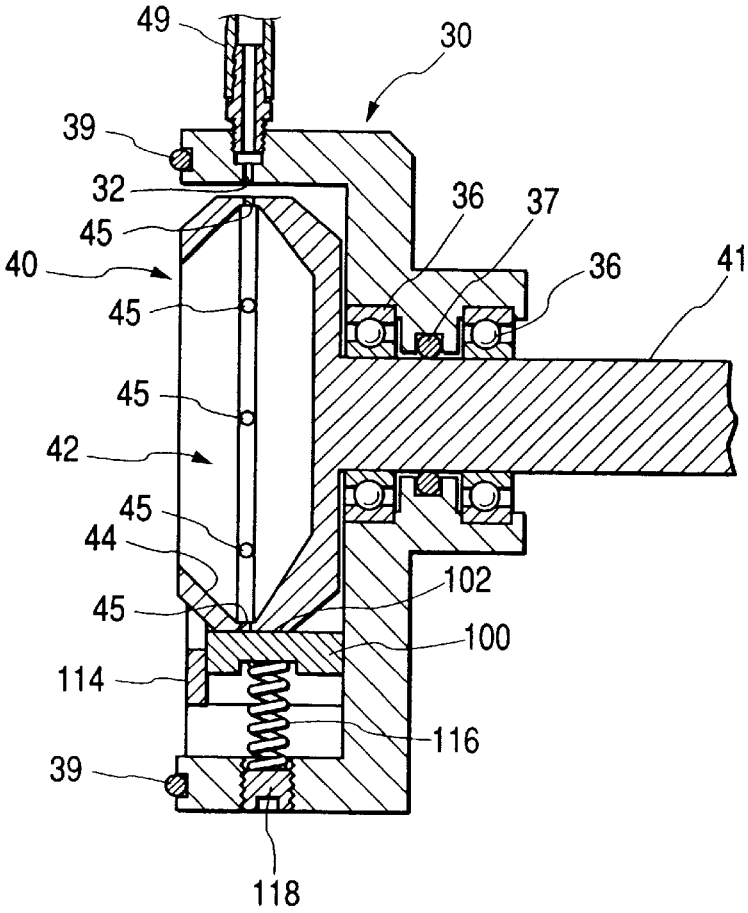
FIG. 10 is a cross sectional view of the apparatus main body case taken along line X—X in FIG. 9.

FIGS. 9 and 10 show another embodiment according to the present invention. FIG. 9 is a plain view of an apparatus main body case as the principal part of a pellet supplying apparatus, and FIG. 10 is a cross sectional view of the apparatus main body case taken along line X—X in FIG. 9.

Although the rotation drum storage part 31 is formed with a rotating member shape so that the inner circumferential surface of the rotation drum storage part 31 contacts slidably with the outer circumferential surface of the rotation drum 40, in this embodiment, the rotation drum storage part 31 is formed with a rectangular shape larger than the rotation drum 40, with a slidably contacting member 100 to be contacted slidably with the circumferential wall lower area of the rotation drum 40, disposed in the rotation drum storage part 31.

That is, the slidably contacting member 100 has a semicircular slidably contacting surface 102 along the outer circumferential surface of the rotation drum 40 so as to be contacted with the outer circumferential surface of the rotation drum 40 from below. Numeral 114 denotes a holding member for forcing the front surface side of the slidably contacting member 100 so as to hold the slidably contacting member 100 slidably in the vertical direction. Numeral 116 denotes a compression coil spring for forcing the slidably contacting member 100 upward (in the direction contacting with the outer circumferential surface of the rotation drum 40). The contact pressure between the rotation drum 40 and the slidably contacting member 100 can be adjusted by a contact pressure adjusting screw 118.

Moreover, the slidably contacting member 100 is provided with a pellet discharging hole 33. A flexible Teflon tube 33*a* connected with the pellet discharging hole 33 is connected with a pellet supply nozzle 34 elongating from the apparatus main body case 30.

In this embodiment, the slidably contacting member 100 is provided only in the portion corresponding to the range in the pellet storage room 42 wherein the pellet group moves around, and the area wherein the pellet storing through holes 45*a* rotate. The other area in the outer circumferential surface of the rotation drum 40 is separated drastically from the inner circumferential surface of the rotation drum storage part 31 so that most of the through holes 45 are released in the rotation drum storage part 31.

Therefore, the slidably contacting area between the rotation drum 40 and the slidably contacting member 100 is small so that the rotation torque of the rotation drum 40 can be small.

Furthermore, since communication between the gas supply hole 32 and the pellet storage room 42 can always be ensured via the rotation drum storage part 31 and a large number of the through holes 45 without the need of providing the manifold 35 in the first embodiment. Moreover, since the contact pressure of the slidably contacting member 100 can be adjusted by the contact pressure adjusting screw 118, accurate process of the inner circumferential surface of the rotation drum storage part 31 or a complicated process of forming the manifold 35 is not required.

Furthermore, in the case the apparatus is used for supply of pellets with a different particle size, by detaching the rotation drum 40 so as to be replaced by a rotation drum having through holes 45 corresponding to the pellet particle size, it can be utilized for the supply of pellets with different particle sizes.

Moreover, since a lid 138 can sway around a hinge 140, by engaging a hook 139 with an engaging part 142 and releasing the engagement, the lid 138 can be easily opened or closed so that inserting pellets into the pellet storage room 42 can be executed easily. In this embodiment, the slidably contacting member 100 can be fixed to the apparatus main body case 30.

Figure 11:
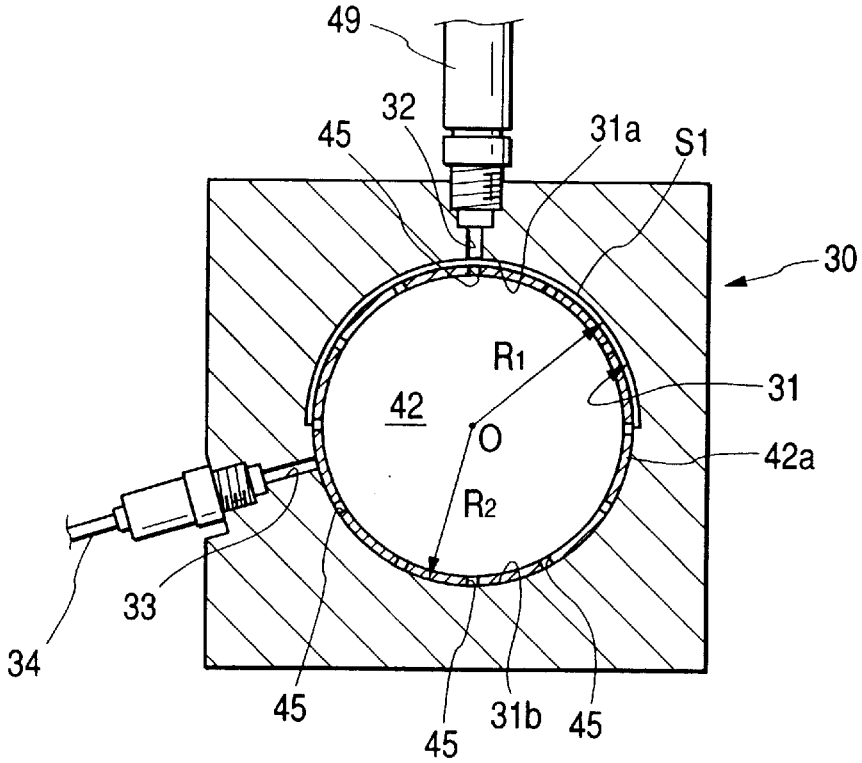
FIG. 11 is a cross-sectional view of an apparatus main body case as the principal part of a pellet supplying apparatus according to the present invention.
Figure 12:
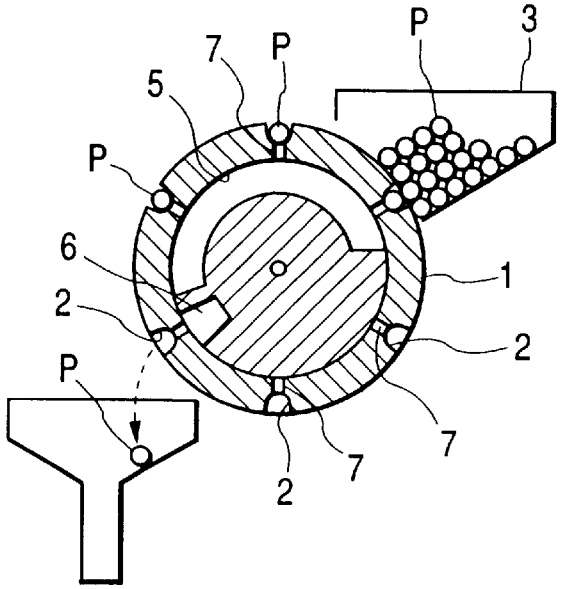
FIG. 12 is a vertical cross-sectional view of a conventional pellet supplying apparatus.

FIG. 11 is a cross-sectional view of an apparatus main body case as the principal part of a pellet supplying apparatus according to another embodiment of the invention. The inner circumferential surface of the rotation drum storage part 31 of the apparatus main body case 30 is formed with a cylindrical shape as in the first embodiment. However, the radius $R_1$ of the inner circumferential surface 31*a* in the upper half region is formed larger than the radium $R_2$ of the inner circumferential surface 31*b* in the lower half region so that only the lower half of the circumferential wall 42*a* of the rotation drum 40 can be contacted slidably with the inner circumferential surface of the rotation drum storage part 31.

Therefore, a predetermined gap $S_1$ (which is equivalent to $R_1$–$R_2$) is formed between the upper half region of the circumferential wall 42*a* and the inner circumferential surface 31*a* of the rotation drum storage part 31 so that the gas supply hole 32 and the through holes 45 are communicated without the need of forming the manifold 35 in the apparatus main body case 30 as well as the inside of the pellet storage room 42 which is always maintained in an Ar gas atmosphere at a predetermined pressure.

Although the inside of the pellet storage room 42 is maintained at a predetermined pressure (0.05 kg/cm$^2$) higher than the atmospheric pressure in the above-mentioned embodiments, so that the pellets P can be discharged into the pellet discharging hole 33 vigorously, the inside of the pellet storage room 42 can be the same pressure as the atmospheric pressure as long as it is maintained in an inert gas atmosphere.

As is apparent from the above-mentioned description, according to the apparatus and method for supplying pellets to an arc tube for a discharge lamp of the invention, since the pellet storage room is provided in the rotation drum disposed in the apparatus main body case in place of the hopper in the conventional apparatus, the apparatus main body is compact.

Moreover, since the pellets in the pellet storage room can be maintained in the inert gas atmosphere until they are discharged from the pellet discharging hole, the problems of deliquescence of the pellets so as to disturb the appropriate supply of the pellets or deterioration of the produced arc tubes is solved.

According to another aspect of the present invention, since the inside of the pellet storage room can be maintained in an inert gas atmosphere, the various problems derived from the moisture absorption by pellets can be solved certainly.

According to another aspect of the present invention, the gas pressure in the pellet storage room can be maintained at a predetermined pressure state so that the pellets can be discharged from the pellet discharging hole one by one smoothly and without cracking the pellets.

According to another aspect of the present invention, since the pellet storage room can be opened or closed easily by swaying the lid, the refilling operation of the pellet group can be facilitated.

According to another aspect of the present invention, since the pellets can be guided to the through holes even in the state with a slight amount of the pellet group remains in the pellet storage room, the pellets can be supplied certainly one by one until the last piece.

According to another aspect of the present invention, since only one pellet is stored in a through hole, the pellets can be supplied one to the chamber of the arc tube one at a time.

While only certain embodiments of the invention have been specifically described herein, it will be apparent that numerous modifications may be made thereto without departing from the spirit and scope of the invention.

The present invention is based on Japanese Patent Application No. Hei. 11-179957 which is incorporated herein by reference.

What is claimed is:

1. An apparatus for supplying pellets to an arc tube for a discharge lamp comprising:

a main body case having a discharge hole for discharging pellets and a rotation drum storage part;

a rotation drum disposed in said rotation drum storage part, said rotation drum having a circumferential wall, through holes in which pellets are received and which coincide with said discharge hole upon rotation of said rotation drum, and a pellet storage room for storing the pellets;

a lid mounted on said main body case for sealing said rotation drum in said main body case;

a pellet supply nozzle extending from said main body case and communicating with the discharge hole; and a gas supply hole for supplying a gas to the pellet storage room.

2. The apparatus for supplying pellets to an arc tube for a discharge lamp according to claim 1, wherein the through holes are sized to allow the pellets to pass therethrough.

3. The apparatus for supplying pellets to an arc tube for a discharge lamp according to claim 1, wherein the through holes are disposed on said circumferential wall of said rotation drum.

4. The apparatus for supplying pellets to an arc tube for a discharge lamp according to claim 3, wherein said through holes on said circumferential wall are spaced at equal intervals around said circumferential wall of said rotation drum.

5. The apparatus for supplying pellets to an arc tube for a discharge lamp according to claim 1, wherein said rotation drum storage part of said main body case has curved surfaces that contacted with said rotation drum for holding pellets in said through holes.

6. The apparatus for supplying pellets to an arc tube for a discharge lamp according to claim 1, wherein an inner circumferential surface of said rotation drum storage part is formed in a cylindrical shape to be contacted slidably with said circumferential wall of said rotation drum.

7. The apparatus for supplying pellets to an arc tube for a discharge lamp according to claim 1, further comprising a groove elongating in a circumferential direction of said rotation drum storage part for ensuring communication between said gas supply hole and at least one of said through holes.

8. The apparatus for supplying pellets to an arc tube for a discharge lamp according to claim 5, wherein said curved surface is provided in a substantially lower half of said circumferential wall of said rotation drum.

9. The apparatus for supplying pellets to an arc tube for a discharge lamp according to claim 1, wherein a gas pressure in the pellet storage room is in the range from 0.02 to 0.1 $kg/cm^2$.

10. The apparatus for supplying pellets to an arc tube for a discharge lamp according to claim 1, wherein said lid is mounted on said main body with a hinge.

11. The apparatus for supplying pellets to an arc tube for a discharge lamp according to claim 1, wherein said inner circumferential wall has a V-shaped groove, said through holes being provided on a bottom part of said V-shaped groove.

12. The apparatus for supplying pellets to an arc tube for a discharge lamp according to claim 1, wherein a depth H of said through holes is in the range from $D/2<H\leqq D$, D being the inner diameter of the through holes.

13. A method for supplying pellets to an arc tube for a discharge lamp comprising the steps of:

placing a group of pellets in a drum having through holes;

sealing said group of pellets in the drum;

inserting the drum in a drum storage part, the drum storage part having a hole to allow for the exit of a pellet from the drum when through holes of the drum coincide with the hole in the drum storage part;

rotating said drum within said drum storage part, said rotating of the drum allowing one pellet from the group of pellets to enter the though hole;

ejecting a pellet from the drum.

14. A method for supplying pellets to an arc tube for a discharge lamp according to claim 13, comprising the further step of applying pressure to the inside of drum.

15. A method for supplying pellets to an arc tube for a discharge lamp according to claim 14, wherein the pressure inside the drum is in the range from 0.02 to 0.1 $kg/cm^2$.

* * * * *